United States Patent [19]

Brian

[11] Patent Number: 4,640,197

[45] Date of Patent: Feb. 3, 1987

[54] ROCKER ARM ASSEMBLY WITH A FIXING COLLAR FOR AN AERIAL TRAMWAY INSTALLATION

[75] Inventor: René Brian, Fontaine, France

[73] Assignee: Pomagalski SA, France

[21] Appl. No.: 716,445

[22] Filed: Mar. 27, 1985

[30] Foreign Application Priority Data

Apr. 13, 1984 [FR] France ..... 84 06257

[51] Int. Cl.[4] ..... B61B 7/00; B61B 12/00; B61B 12/06

[52] U.S. Cl. ..... 104/179; 104/197; 384/543; 200/61.08

[58] Field of Search ..... 104/180, 182, 197, 179, 104/115, 116, 178; 305/28; 105/180; 200/61.08, 61.4; 188/1.11; 384/495, 537, 543, 544, 558, 584, 585, 589

[56] References Cited

U.S. PATENT DOCUMENTS

| | | | |
|---|---|---|---|
| 2,947,829 | 8/1960 | Fish | 200/61.08 |
| 3,822,369 | 7/1974 | Kunczynski | 200/61.08 |
| 4,220,095 | 9/1980 | Segafredo | 104/179 |
| 4,462,314 | 7/1984 | Kunczynski | 104/197 X |

FOREIGN PATENT DOCUMENTS

| | | |
|---|---|---|
| 373832 | 2/1984 | Austria . |
| 0086084 | 8/1983 | European Pat. Off. . |
| 2387830 | 11/1978 | France . |
| 2392858 | 12/1978 | France . |
| 2391450 | 12/1978 | France . |

*Primary Examiner*—Robert B. Reeves
*Assistant Examiner*—Scott H. Werny
*Attorney, Agent, or Firm*—Parkhurst & Oliff

[57] ABSTRACT

A rocker arm assembly (12), supporting the rope of an aerial tramway installation, comprises sheaves (14, 16), the spindles (18, 20) of which are fitted enabling their disassembly, cantilevered from an arm (22) fitted on the inward facing side of the sheaves. The arm (22), made of moulded material, has a rope catcher shoe (66), which protrudes on the outward facing side of the sheaves. A detector of excessive rocker arm (22) swing, due to the rope falling on the catcher shoe (66) or to a sheave being lost, is incorporated in the boss of the arm and protrudes into a shearing groove in the articulation spindle of the arm (22).

3 Claims, 7 Drawing Figures

14
68
66
52
22
26
54
58
28
54
62
62
60
56
64
64
24
82
80
84
86
90

ROCKER ARM ASSEMBLY WITH A FIXING COLLAR FOR AN AERIAL TRAMWAY INSTALLATION

BACKGROUND OF THE INVENTION

The invention relates to a device supporting or maintaining the rope of an aerial tramway installation, having a set of rocker arm assemblies mounted at intervals along the rope.

U.S. Pat. No. 4,220,095 describes a device of the kind mentioned which enables the rope to be supported or compressed by a series of small diameter sheaves or wheels, without imposing excessive bending on the rope, the rocker arm assemblies pivoting to evenly distribute the load on the sheaves. The sheaves of each rocker arm assembly are mounted between two plates forming a supporting cover, itself articulated on a cover coupling two successive rocker arm assemblies. The sheaves are secured between the two plates and the support spindle has to be extracted for them to be disassembled. Repairs are often carried out on the site, under particularly harsh conditions, at the top of a tower or in rain or snow, which explains the incidents and faulty repairs which affect smooth running of the installation. Damage to a bearing may lead to a seizure and a sheave being lost. Disassembling a rocker arm assembly is also complicated.

American Pat. No. 4,462,314 describes a rocker arm assembly with sheaves mounted cantilevered from a spindle secured to an arm. This arm is mounted cantilevered from a bent arm which frees the sheaves completely for ease of disassembly. This device is complicated and does not prevent the sheave ball-bearing from being damaged when the sheave is extracted.

SUMMARY OF THE INVENTION

It has become necessary to be able to disassemble the sheaves and/or a complete rocker arm assembly easily while keeping the structure simple and rugged, an objective which is achieved by the support device according to the invention, in which the rotating spindles of the rocker arm sheaves are mounted cantilevered from the rocker arms, each spindle being slotted and rigidly fixed onto the rocker arm, and able to be disassembled, to enable a sheave-spindle assembly to be replaced by simply disassembling the spindle cantilevered from said arm and removing the sheave-spindle assembly.

The sheave is mounted on the spindle in the factory or workshop with all due care to prevent the bearings being damaged. Fixing the spindle onto the rocker arm does not require any special care, and merely involves slotting the spindle into a housing on the rocker arm and tightening the fixing bolt. Cantilevered mounting enables the sheave-spindle assembly to be fitted or removed without having to remove the side plates.

The rocker arm is mounted, according to an improved embodiment of the invention, on the inward facing side of the sheaves, that is to say on the opposite side from the passage of the load-carrying hanger arms coupled to the rope. In the case of a conventional tower, the rocker arm is mounted between the sheaves and the tower, the cantilevered spindles extending outwards. This arrangement makes it easier for the grips to pass, particularly on a pivoted rocker arm which has lost one of its sheaves.

The rocker arm is a moulded part, the central boss of which bears a shoe, protruding on the outward facing side of the sheaves, acting as a catcher for an outwardly derailed rope. The catcher shoe is off center with respect to the rocker arm articulation spindle, so as to impose a pivoting movement on the latter caused by the impact of the rope falling on the shoe. Cantilevered mounting of the rocker arm sheaves introduces a dissymmetry, but the forces exerted on the sheaves are sufficiently low to allow this kind of assembly. Symmetry is on the other hand preserved at the level of the covers linking the rocker arm assemblies, which comprise two straight plates or side plates, enclosing the rocker arms on both sides. These plates, which are at much the same height as the straight arm of the rocker arm assembly, do not hinder sheave disassembly, if care is taken to pivot the arm with respect to the plate to disengage the sheave.

Disassembling or assembling a rocker arm assembly is made easier by the possibility, according to the invention, of removing one of the side plates. To this end, the plates are bolted onto two flanges of a boss forming a spacer, advantageously made of moulded material.

According to an important development of the invention, excessive rocker arm assembly swing, due either to a sheave being lost or to the rope falling on the catcher, is detected by a frangible conducting strip breaking. This strip is inserted in a radial hole in the rocker arm boss and its end protrudes into a groove in the articulation spindle. The length of this groove corresponds to the pivoting swing the rocker arm is allowed to have so that any excess swing either way causes the protruding end to be sheared or broken off. The conducting strip is buried in a moulded insulating plug-shaped part, fixed for example by screwing into the radial hole of the boss. The hole opens downwards to prevent water or humidity getting in, and tightness can be improved by seals fitted between the spindle and the boss preventing any infiltration along the spindle towards the frangible strip. The conducting strip is coupled to two connecting wires which provide the connection with the installation safety line. This wires and strip assembly is coated with moulded material to give a perfect electrical connection. It is clear that the strip can be replaced by another contact system, for example using a liquid container.

BRIEF DESCRIPTION OF THE DRAWINGS

Other advantages and characteristics will become more clearly apparent from the following description of a specific embodiment of the invention, by way of example only, and represented by the accompanying drawings in which.

Figure 1:
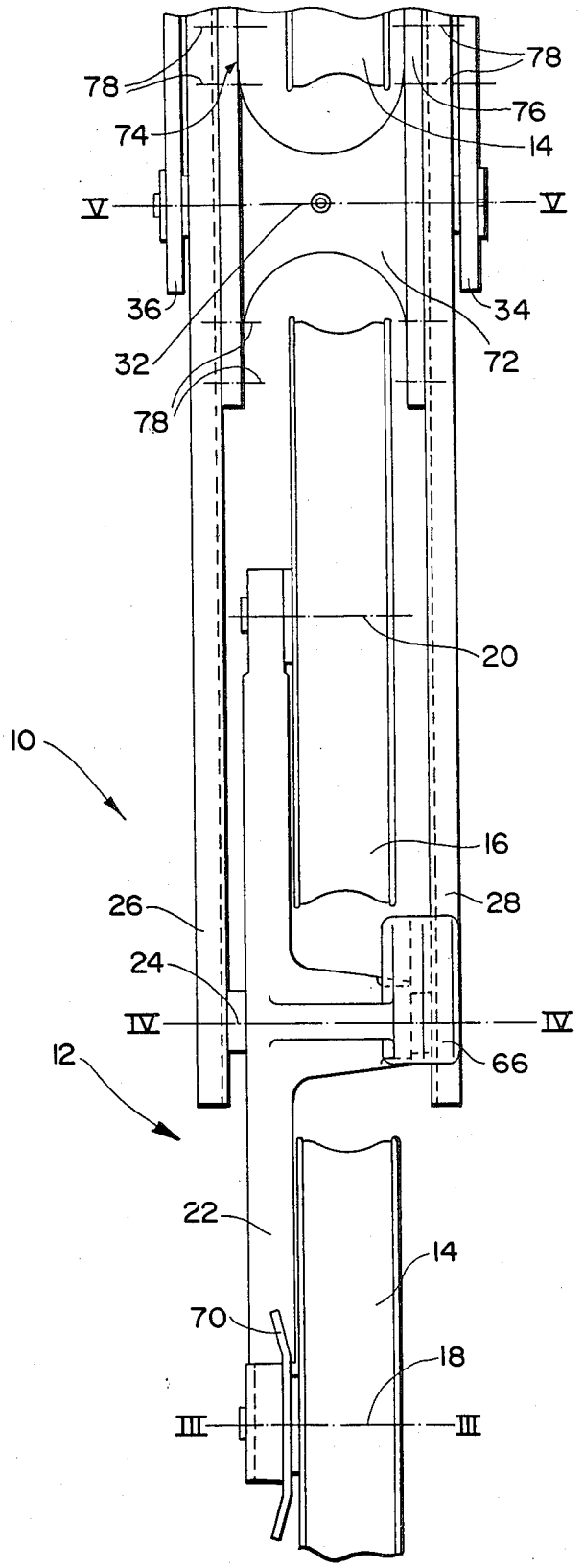
FIG. 1 is a partial plan view of a support device according to the invention.
Figure 2:
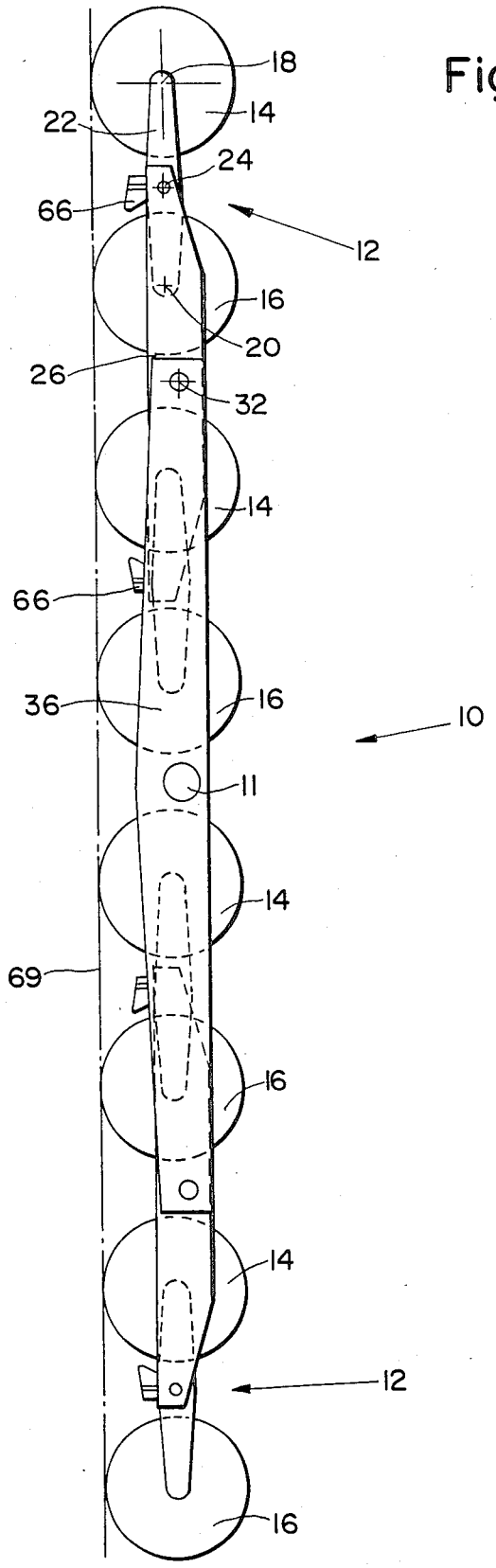
FIG. 2 is a reduced scale elevational view of the device of FIG. 1.

In the figures, a rocker arm assembly 10 is articulated on a support spindle 11 supported by a tower. Each rocker arm 12 supports a pair of sheaves 14, 16 or wheels, rotatively mounted on spindles 18, 20, fixed onto a rocker arm 22. The spindles 18, 20 are mounted at the ends of the arm 22, in the form of a straight beam, articulated in the middle on a spindle 24. The spindles 24 of two successive rocker arm assemblies 12 are linked by a pair of plates 26, 28 forming a cover 30 enclosing the rocker arm assemblies 12, the cover 30 being itself articulated in the middle on a spindle 32 which can be the spindle 11 fixed to the tower, if the assembly 10 comprises only two rocker arms 12 or can be supported by another cover comprising two plates 34, 36 if the number of rocker arms 12 is greater. Rocker arm assemblies 12 of this kind supporting or compressing a rope are well known.

Figure 3:
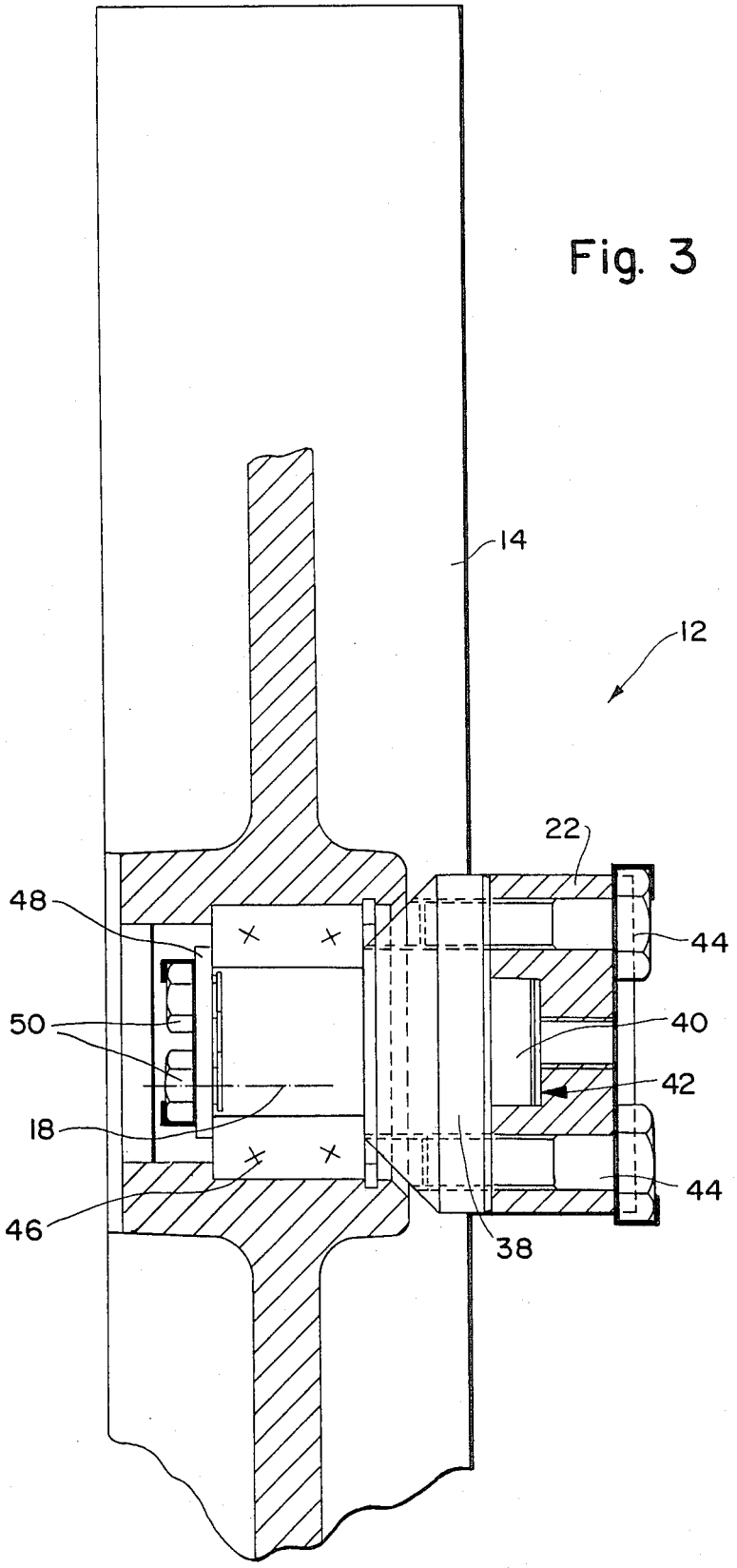
FIGS. 3, 4 and 5 are cross-sections, respectively along lines III—III, IV—IV and V—V of FIG. 1.

Referring more particularly to FIG. 3, it can be seen that the sheaves 14, 16 of the rocker arm assembly 12 are mounted laterally cantilevered from the rocker arm 22. Only the method of fixing sheave 14 is described hereafter, as the method for sheave 16 is identical. Spindle 18 of sheave 14 has a collar 38 at one of its ends, which is applied against the lateral face of the arm 22 of the same height and a centering pin 40 which slots into a hole 42 in the arm 22. Bolts 44 secure the collar 38 to the arm 22. A bearing 46 is fitted on the opposite end of the spindle 18, its outer housing supporting the boss of sheave 14. The bearing 46 is held in place by a washer 48 and bolt 50 system. By loosening the bolts 44 and shifting the spindle 18 slightly to the left, as seen in FIG. 3, to remove the pin 40 from the hole 42, the sheave 14—spindle 18 assembly can be removed or a new workshop prepared sheave 14—spindle 18 assembly be fitted. This fitting operation is simple and does not affect the bearing 46, which constitutes the noble part of this assembly.

Cantilevered mounting of spindles 18, 20 from the rocker arm 22 enables this disassembly and reassembly operation to be carried out, sheave 14 being completely freed and sheave 16 being able to be freed by simply pivoting the arm 22 to disengage the sheave 16 from the plates 26, 28.

Figure 4:
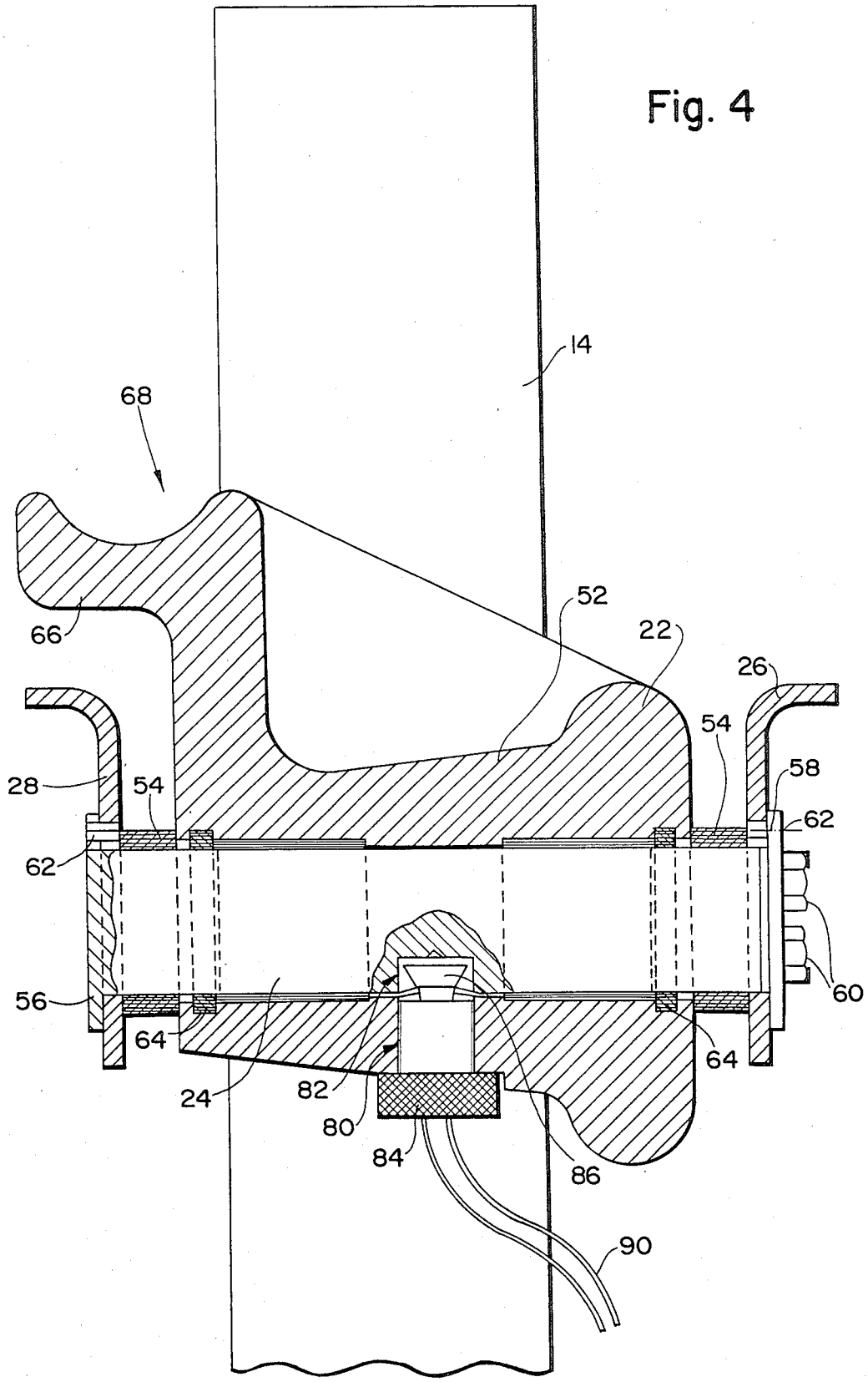

The rocker arm 22 is a moulded part having a boss 52 in the middle through which the articulation spindle 24 passes (FIG. 4). The boss 52 is enclosed by the plates 26, 28 of the cover 30 with wedges 54 interposed, spindle 24 passing through holes in the plates 26, 28. Spindle 24 has at one end a head 56 which is in abutment against the outer face of the plate 28 and at the other end a washer 58 fixed by bolts 60 which is in abutment against the outer face of the plate 26. Bolts 62 prevent the spindle 24 from rotating and seals 64 fitted in annular grooves at both ends of the boss 52 engage the spindle 24 in friction.

The boss 52 bears or is shaped into a shoe 66 protruding out from the sheave 14 to the left in FIG. 4. The shoe 66 has on its upper face a recess 68 to catch a rope 69 derailed from sheave 14 and falling to the left which corresponds to the outward facing side of sheave 14. It is known that the outward facing side corresponds to the side on which the load-bearing hanger arms coupled to the rope pass and is opposite the rocker arm assembly 10 support tower. A rope derailment on the tower side is prevented by a fixed guide 70, associated with sheave 14. The rope catcher 66 extends above the plate 28 at a predetermined distance from the latter, to allow normal pivoting of the rocker arm assembly 12 and to stop against the plate 28 when excessive pivoting occurs. In this way vertical pivoting of the rocker arm 22 is prevented when a sheave is lost, for example sheave 14. The rocker arm assembly 12 stopped by the plate 28 allows the grip to pass and the rope remains supported by the sheave 16. Mounting the arm 22 on the inward facing side of the sheaves 12, 14 makes this passage easier.

Figure 5:
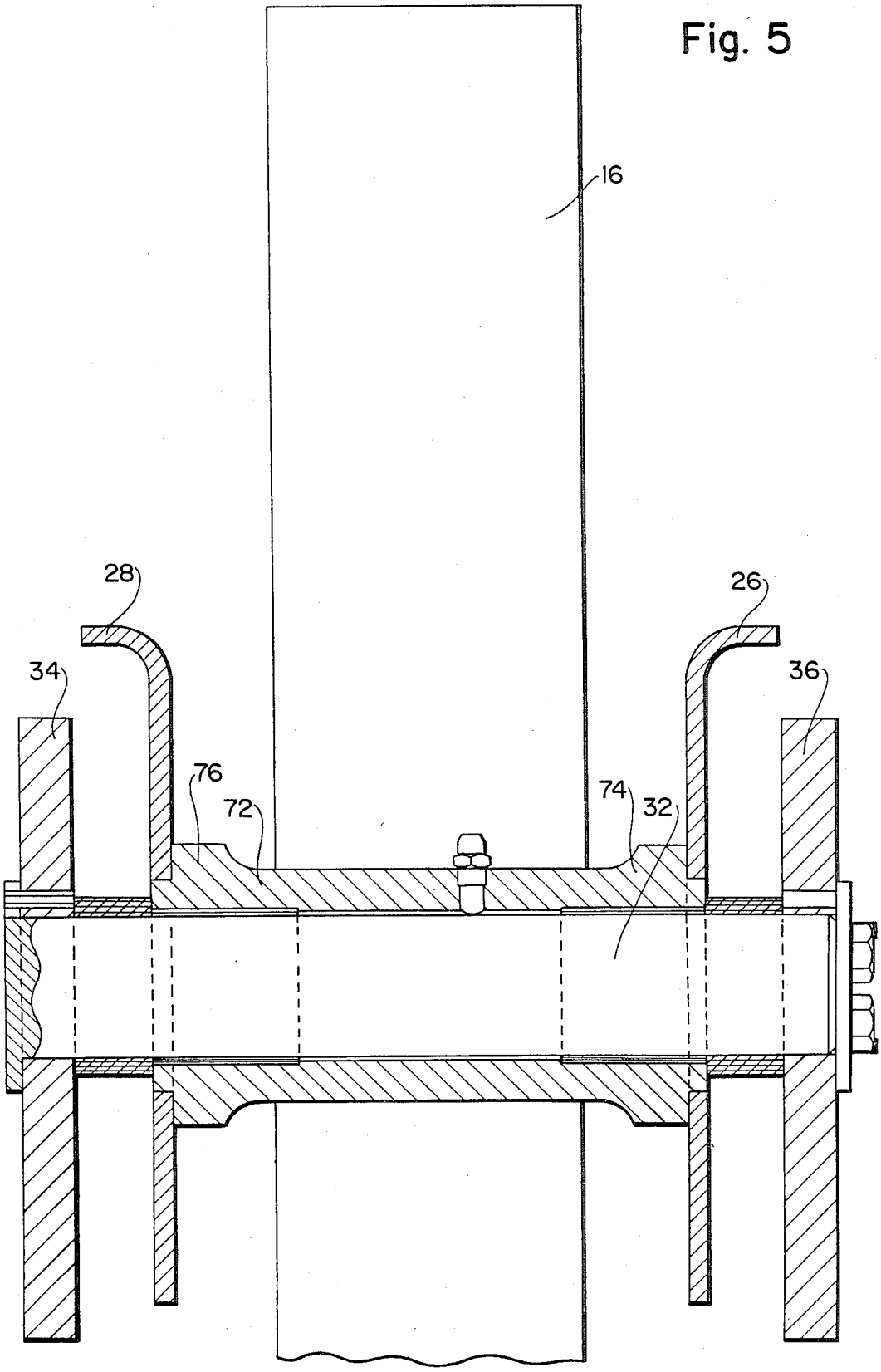
Figure 6:
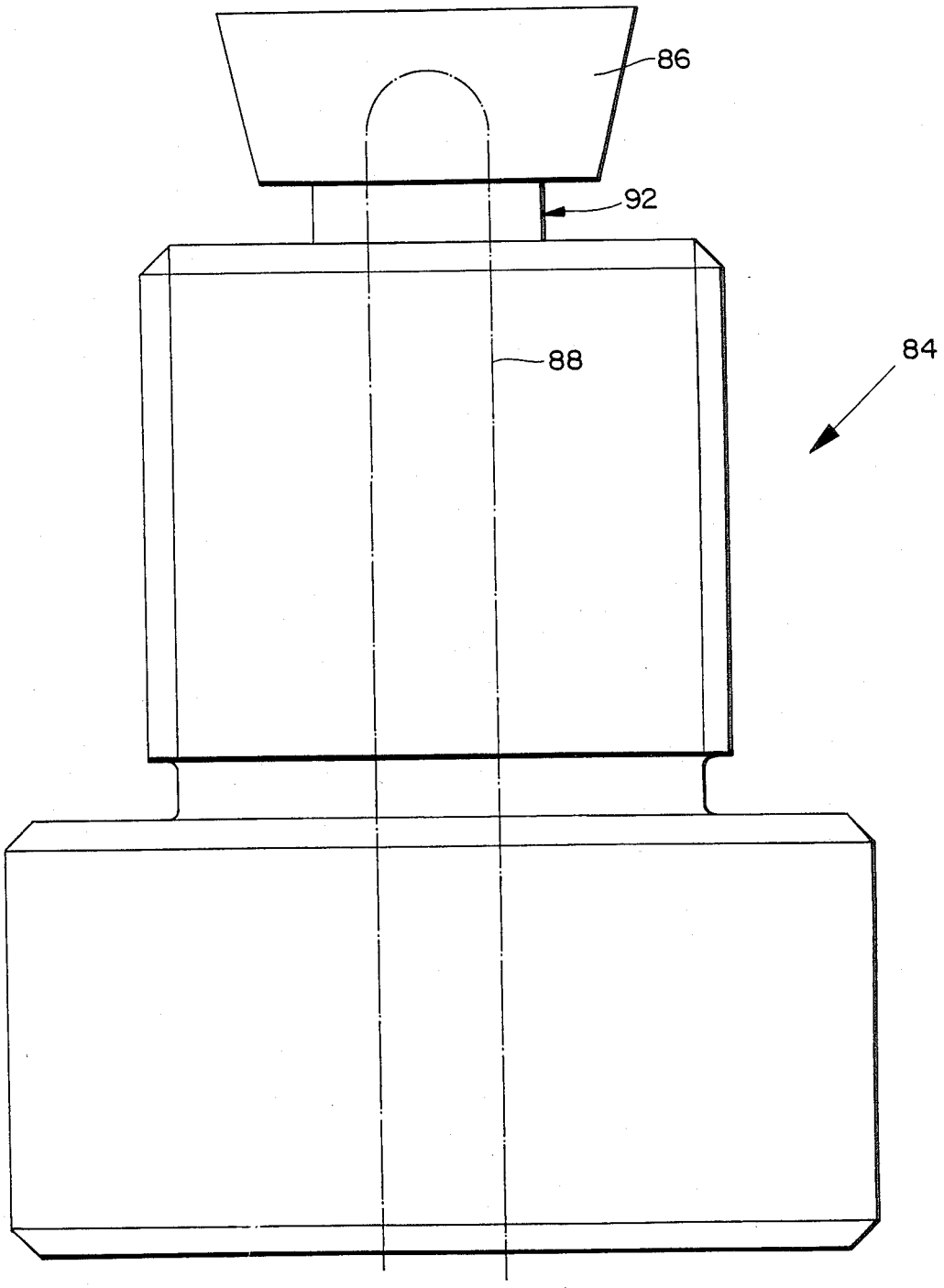
FIG. 6 is an enlarged scale view of the detector according to FIG. 4.
Figure 7:
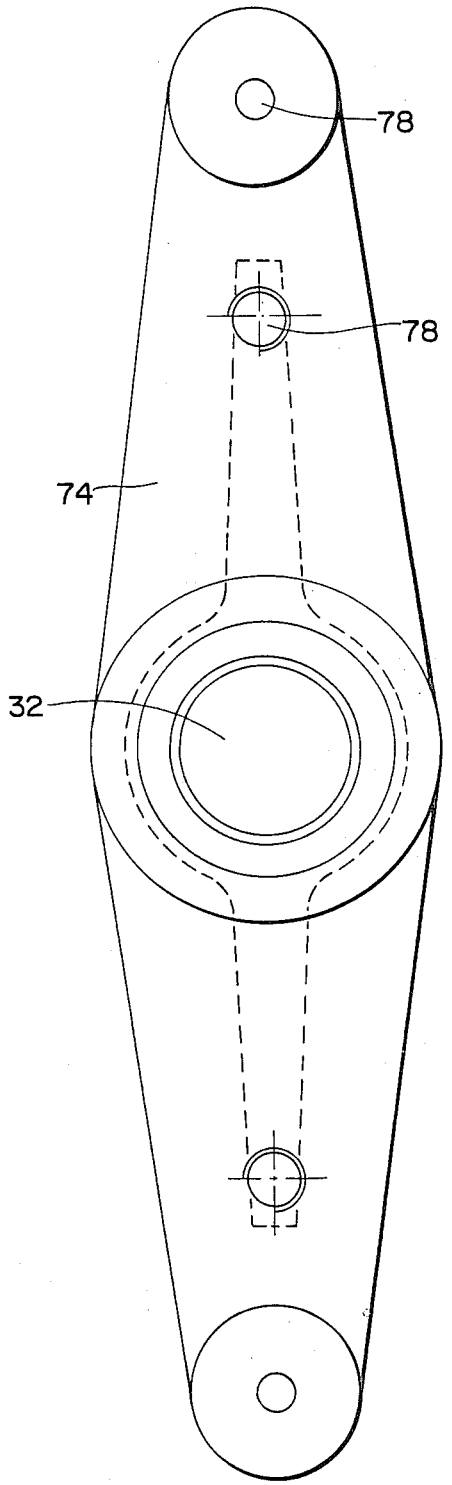
FIG. 7 is a side view of the spacer boss according to FIG. 5.

The plates 26, 28 are joined together at their middle by a spacer boss 72, rotatedly mounted on spindle 32 supported by plates 34, 36. Fixing spindle 32 to plates 34, 36 is identical to that described above for spindle 24 and plates 26, 28 (FIG. 5). The boss 72 is a moulded part having two lateral flanges 74, 76 for fixing by means of bolts 78 of plates 26, 28. By disassembling one of the plates 26, 28, the rocker arm 22 can be removed, it being necessary of course to unscrew the bolts 60 securing its spindle 24.

The lower part of the boss 52 of the rocker arm 22 has a radial hole 80 running through it, threaded and opening downwards. The spindle 24 has lined up with hole 80 a groove 82 in the shape of a circular arc, whose length corresponds to the normal swing of the arm 22, the groove 82 remaining lined up with hole 80 for all normal swing positions. Screwed into hole 80 there is a plug-shaped detector 84, with one end in the shape of a pin 86 which fits into the groove 82. Detector 84 is a moulded insulating part, housing a loop conductor 88 constituted by a frangible strip which enters the pin 86. The conductor 88 is coupled to two wires 90 connecting it to the installation safety line. The pin 86 is connected to the plug 84 by a tapered part 92 which can be fractured. When excessive pivoting of the boss 52 of arm 22 occurs, the end of the groove 82 knocks against the pin 86 and shears it breaking the strip 88 and interrupting the safety line circuit. After it has been cut, the detector 84 is unscrewed and replaced by a new one to enable the installation to be restarted. The detector 84 is protected, particularly from humidity, and any false contact is excluded. Excessive pivoting of the rocker assembly arm 22, detected by shearing of the pin 86, can result from the rope falling on the catcher shoe 66 or from the loss of a sheave 14, 16 of the rocker arm assembly. The detector 84 can be replaced by a simple bolt (not shown), which enters the groove 82 and prevents excessive pivoting of the rocker arm assemblies 12 during transport and installation. Before the installation is started up, the bolt must of course of replaced by the detector plug 84.

It is pointless describing the operation of the rocker arm assembly 10 or of the detector 84, brought out by the above description, and it is sufficient to recall that the arrangement is simple and rugged and makes disassembly and reassembly easy. The rocker arm assembly can be applied to supporting or maintaining a carrier-hauler rope of a gondola-lift or chair-lift or any other aerial tramway. Any number of elements can make up the rocker arm assembly, and any type of sheave may be used.

I claim:

1. An aerial tramway installation including a rope, load-bearing hanger arm grips coupled to the rope, and a rope supporting device comprising rocker assembly arms, rope support sheaves having an external side, said hanger arm grips passing said external side, and an internal side, the rocker assembly arm being disposed on said internal side, each sheave having a bearing and a rotation spindle on which the bearing is mounted, each rocker assembly arm supporting at ends thereof a sheave rotation spindle, a pair of straight side plates in the form of a cover having at ends thereof a pivoting spindle fitted between said plates, said rocker assembly arm being pivotally mounted on said spindle, said sheave rotation spindles having internal sheave sides, a fixing collar and a centering pin, said rocker assembly arm having an orifice into which said centering pin is fitted with a small amount of clearance and a bearing face against which said collar is in abutment for cantilevered mounting of the rotation spindle from the rocker assembly arm and fixing means to secure said collar to said rocker assembly arm.

2. The installation according to claim 1, further comprising a derailed rope catcher shoe fixed to the rocker assembly arm above the rocker arm assembly rotation spindle and protrudes out from external sides of the sheaves, said catcher shoe being off center with respect to said rotation spindle whereby the rocker assembly arm pivots when a force is exerted by the rope falling on the catcher shoe, said catcher shoe cooperating with an adjacent one of said side plates to constitute a stop which limits pivoting of the rocker arm when a rocker assembly sheave becomes detached.

3. The installation according to claim 1, further comprising an excessive rocker arm swing detector comprising a threaded plug with a shearable head, and a frangible conducting strip which when broken causes shutdown of the installation by safety line interruption, said strip being fitted at rocker arm pivoting spindle level and being incorporated in said plug, a radial hole in the rocker assembly arm being axially aligned with the pivoting spindle into which said plug is screwed, and a groove in said pivoting spindle being axially aligned with said hole, the plug head engaging the groove with the plug in the screwed-in position, so as to be sheared by the base of the groove when said rocker assembly arm swings excessively.

* * * * *